United States Patent [19]

Teumer et al.

[11] 4,073,583

[45] Feb. 14, 1978

[54] PHOTOELECTROPHORETIC HEAT AND PRESSURE TRANSFER MECHANISM

[75] Inventors: Roger G. Teumer, Fairport; Peter J. Warter, Jr., Penfield; Gino F. Squassoni, Pittsford; Vseevolod Tulagin, Rochester; Raymond K. Egnaczak, East Williamson, all of N.Y.

[73] Assignee: Xerox Corporation, Stamford, Conn.

[21] Appl. No.: 571,170

[22] Filed: Apr. 24, 1975

[51] Int. Cl.[2] ..... G03G 17/04

[52] U.S. Cl. ..... 355/3 P; 355/3 TR; 355/3 FU

[58] Field of Search ..... 355/3 P, 3 TR, 3 FU; 96/1 PE, 1.4; 204/299 PE, 300 PE

[56] References Cited

U.S. PATENT DOCUMENTS

| | | | |
|---|---|---|---|
| 3,591,276 | 7/1971 | Byrne | 355/3 TR |
| 3,784,294 | 1/1974 | Wells | 355/3 P |
| 3,844,779 | 10/1974 | Weigl | 355/3 P |
| 3,893,761 | 7/1975 | Buchan et al. | 355/3 TR |
| 3,945,724 | 3/1976 | Jackson | 355/3 P |

*Primary Examiner*—A. D. Pellinen

*Attorney, Agent, or Firm*—James R. Ralabate; Eugene O. Palazzo; John E. Crowe

[57] ABSTRACT

Photoelectrophoretic apparatus for accomplishing transfer and fixing in one step by application of heat and pressure. In an alternative embodiment, an electric field is provided simultaneously with the application of heat and pressure.

3 Claims, 12 Drawing Figures

PHOTOELECTROPHORETIC HEAT AND PRESSURE TRANSFER MECHANISM

BACKGROUND OF THE INVENTION

This invention relates in general to photoelectrophoretic imaging machines and, more particularly, an improved web device color copier photoelectrophoretic imaging machine.

In the photoelectrophoretic imaging process, monochromatic including black and white or full color images are formed through the use of photoelectrophoresis. An extensive and detailed description of the photoelectrophoretic process is found in U.S. Pat. Nos. 3,384,488 and 3,383,565 to Tulagin and Carreira; 3,383,993 to Yeh and 3,384,566 to Clark, which disclose a system where photoelectrophoretic particles migrate in image configuration providing a visible image at one or both of two electrodes between which the particles suspended within an insulating carrier is placed. The particles are electrically photosensitive and are believed to bear a net electrical charge while suspended which causes them to be attracted to one electrode and apparently undergo a net change in polarity upon exposure to activating electromagnetic radiation. The particles will migrate from one of the electrodes under the influence of an electric field through the liquid carrier to the other electrode.

The photoelectrophoretic imaging process is either monochromatic or polychromatic depending upon whether the photosensitive particles within the liquid carrier are responsive to the same or different portions of the light spectrum. A full-color polychromatic system is obtained, for example, by using cyan, magenta and yellow colored particles which are responsive to red, green and blue light respectively.

In photoelectrophoretic imaging generally, and as employed in the instant invention, the important broad teachings in the following five paragraphs should be noted.

Preferably, as taught in the four patents referred to above, the electric field across the imaging suspension is applied between electrodes having certain preferred properties, i.e., an injecting electrode and blocking electrode, and the exposure to activating radiation occurs simultaneously with field application. However, as taught in various of the four patents referred to above and Luebbe et al, U.S. Pat. No. 3,595,770; Keller et al, U.S. Pat. No. 3,647,659 and Carreira et al, U.S. Pat. No. 3,477,934, such a wide variety of materials and modes for associating an electrical bias therewith, e.g., charged insulating webs, may serve as the electrodes, i.e., the means for applying the electric field across the imaging suspension, that opposed electrodes generally can be used; and that exposure and electrical field applying steps may be sequential. In preferred embodiments herein, one electrode may be referred to as the injecting electrode and the opposite electrode as the blocking electrode. This is a preferred embodiment description. The terms blocking electrode and injecting electrode should be understood and interpreted in the context of the above comments throughout the specification and claims hereof.

It should also be noted that any suitable electrically photosensitive particles may be used. Kaprelian, U.S. Pat. No. 2,940,847 and Yeh, U.S. Pat. No. 3,681,064 disclose various electrically photosensitive particles, as do the four patents first referred to above.

In a preferred mode, at least one of the electrodes is transparent, which also encompasses partial transparency that is sufficient to pass enough electromagnetic radiation to cause photoelectrophoretic imaging. However, as described in Weigl, U.S. Pat. No. 3,616,390, both electrodes may be opaque.

Preferably, the injecting electrode is grounded and a suitable source of difference of potential between injecting and blocking electrodes is used to provide the field for imaging. However, such a wide variety of variations in how the field may be applied can be used, including grounding the blocking electrode and biasing the injecting electrode, biasing both electrodes with different bias values of the same polarity, biasing one electrode at one polarity and biasing the other at the opposite polarity of the same or different values, that just applying sufficient field for imaging can be used.

The photoelectrophoretic imaging system disclosed in the above-identified patents may utilize a wide variety of electrode configurations including a transparent flat electrode configuration for one of the electrodes, a flat plate or roller for the other electrode used in establishing the electric field across the imaging suspension.

The photoelectrophoretic imaging system of this invention utilizes web materials, which optimally may be disposable. In this system, the desired, e.g., positive image, is formed on one of the webs and another web will carry away the negative or unwanted image. The positive image can be fixed to the web upon which it is formed or the image transferred to a suitable backing such as paper. The web which carries the negative image can be rewound and later disposed of. In this successive color copier photoelectrophoretic imaging system employing consumable webs, cleaning systems are not required.

Web machine patents may be found in the photoelectrophoretic, electrophotography, electrophoresis and coating arts. In the photoelectrophoresis area is Mihajlov U.S. Pat. No. 3,427,242. This patent discloses continuous photoelectrophoretic apparatus but using rotary drums for the injecting and blocking electrodes instead of webs. The patent to Mihajlov also suggests the elimination of cleaning apparatus by passing a web substrate between the two solid rotary injecting and blocking electrodes. U.S. Pat. No. 3,586,615 to Carreira suggests that the blocking electrode may be in the form of a continuous belt. U.S. Pat. No. 3,719,484 to Egnaczak discloses continuous photoelectrophoretic imaging process utilizing a closed loop conductive web as the blocking electrode in conjunction with a rotary drum injecting electrode. This system uses a continuous web cleaning system but suggests consumable webs in place of disclosed continuous webs to eliminate the necessity for cleaning apparatus. U.S. Pat. No. 3,697,409 to Weigl discloses photoelectrophoretic imaging using a closed loop or continuous injecting web in direct contact with a roller electrode and suggests that the injecting web may also be wound between two spools. U.S. Pat. No. 3,697,408 discloses photoelectrophoretic imaging using a single web but only one solid piece. U.S. Pat. No. 3,702,289 discloses the use of two webs but two solid surfaces. U.S. Pat. No. 3,477,934 to Carreira discloses that a sheet of insulating material may be arranged on the injecting electrode during photoelectrophoretic imaging. The insulating material may comprise, inter alia, baryta paper, cellulose acetate or polyethylene coated papers. Exposure may be made through the injecting electrode or blocking electrode. U.S. Pat. No.

3,664,941 to Jelfo teaches that bond paper may be attached to the blocking electrode during imaging and that exposure could be through the blocking electrode where it is optically transparent. This patent further teaches that the image may be formed on a removable paper substrate or sleeve superimposed or wrapped around a blocking electrode or otherwise in the position between the electrode at the site of imaging.

U.S. Pat. No. 3,772,013 to Wells discloses a photoelectrophoretic stimulated imaging process and teaches that a paper sheet may comprise the insulating film for one of the electrodes and also discloses that exposure may be made through this electrode. This insulating film may be removed from the apparatus and the image fused thereto.

U.S. Pat. Nos. 3,761,174 and 3,642,363 to Davidson disclose apparatus for effecting the manifold imaging process wherein an image is formed by the selective transfer of a layer of imaging material sandwiched between donor and receiver webs.

U.S. Pat. Nos. 2,376,922 to King; 3,166,420 to Clark; 3,182,591 to Carlson and 3,598,597 to Robinson are patents representative of web machines found mostly in the general realm of electrophotography. These patents disclose the broad concept of bringing two webs together, applying a light image thereto at the point of contact and by the application of an electric field effecting a selective imagewise transfer of toner from one web to the other.

SUMMARY OF THE INVENTION

It is an object of this invention to provide an improved photoelectrophoretic imaging machine employing the use of disposable webs.

Another object of this invention is to provide a photoelectrophoretic imaging machine which does not require the use of complex cleaning systems.

Another object of the present invention is to provide a photoelectrophoretic imaging machine capable of utilizing both opaque and transparent inputs.

Still another object of this invention is to provide a photoelectrophoretic imaging machine designed to provide maximum flexibility for changes in process configuration and not thereby unduly upset the remaining portions of the machine.

Yet another object of the present invention is to provide a photoelectrophoretic imaging device designed so that two webs are driven in synchronism at the imaging and transfer stations.

Still a further object of this invention is to provide a photoelectrophoretic imaging machine in which fresh web surfaces are used for each image.

These and other objects of this invention are accomplished by the use of a photoelectrophoretic imaging machine for producing, in a preferred embodiment, full color copies from opaque originals or, alternatively, copies from transparencies.

In a preferred embodiment, the formation of photoelectrophoretic images occur between two thin injecting and blocking webs at least one of which is partially transparent and the image formed is transferred to a paper web. The injecting and blocking webs may be disposable, thus, cleaning systems are not required. The injecting web is provided with a conductive surface and is driven in a path to the inking station where a layer of photoelectrophoretic ink is applied to the conductive web surfaces. The inked injecting web is driven in a path passing in close proximity to the deposition scorotron at the precharge station and into contact with the blocking web to form the ink-web sandwich at the imaging roller in the imaging zone. The conductive surface of the injecting web is grounded and a high voltage is applied to the imaging roller subjecting the sandwich to a high electric field at the same time as the scanning optical image is focussed on the nip or interface between the injecting and blocking webs, and development takes place. The photoelectrophoretic image is carried by the injecting web to the transfer zone, into contact with the paper web at the transfer roller where the image is transferred to the paper web giving the final copy. In one preferred embodiment, machine components and subsystems are arranged and operated to accomplish the process of inking, imaging and transfer concurrently.

BRIEF DESCRIPTION OF THE DRAWINGS

These and other objects and advantages will become apparent to those skilled in the art after reading the following description taken in conjunction with the accompanying drawings wherein.

DESCRIPTION OF THE PREFERRED EMBODIMENTS

The invention herein is described and illustrated in specific embodiments having specific components listed for carrying out the functions of the apparatus. Nevertheless, the invention need not be thought as being confined to such specific showings and should be construed broadly within the scope of the claims. Any and all equivalent structures known to those skilled in the art can be substituted for specific apparatus disclosed as long as the substituted apparatus achieves a similar function. It may be that systems other than photoelectrophoretic imaging systems will be invented wherein the apparatus described and claimed herein can be advantageously employed and such other uses are intended to be encompassed in this invention as described and claimed herein.

THE PHOTOELECTROPHORETIC WEB DEVICE MACHINE

Figure 1:
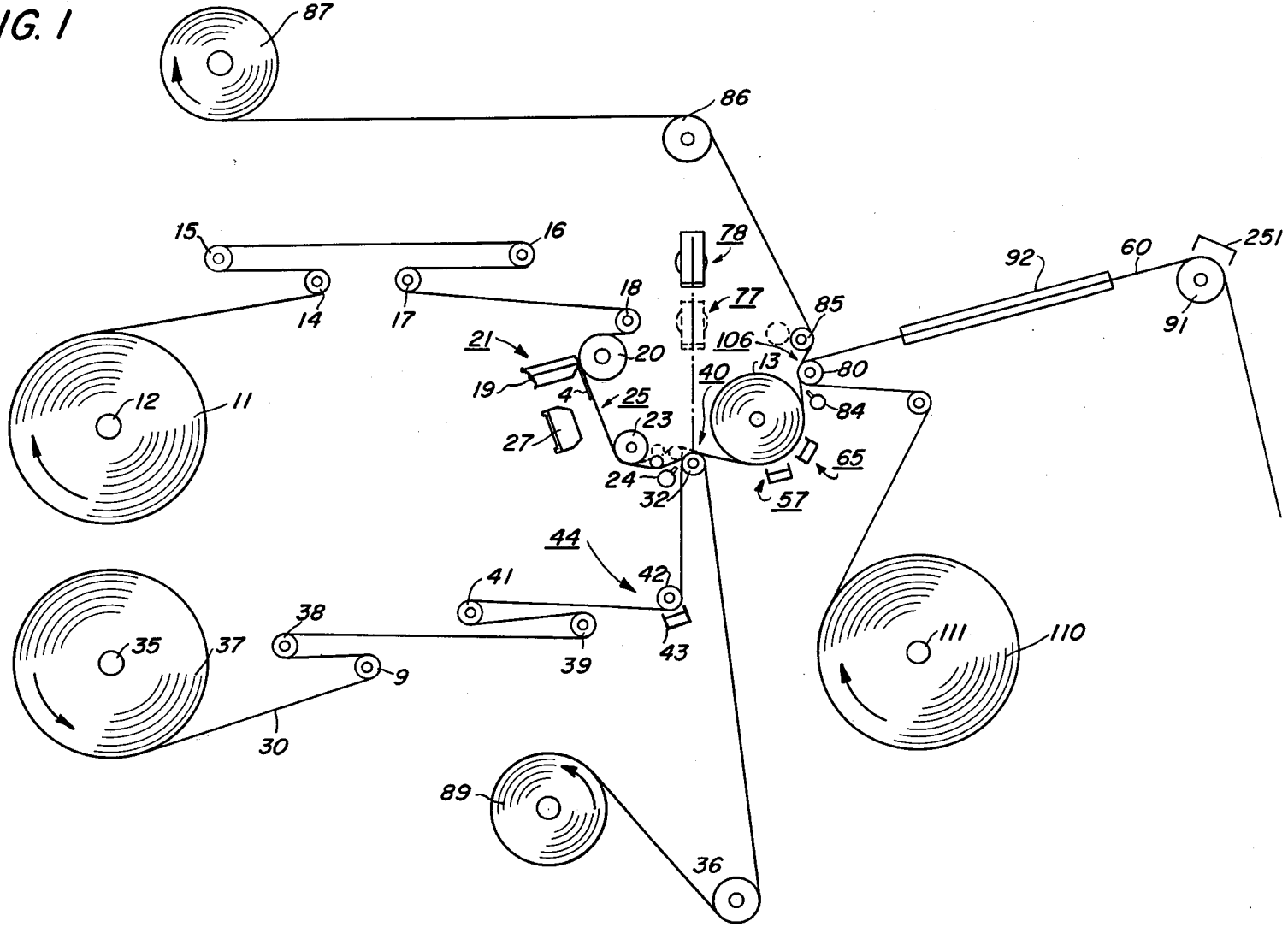
FIG. 1 is a simplified layout, side view, partially schematic diagram of a preferred embodiment of the web device photoelectrophoretic imaging machine according to this invention.

The FIG. 1 shows a simplified layout, side view, partially schematic diagram of the preferred embodiment of the web device color copier photoelectrophoretic imaging machine 1, according to this invention. Three flexible thin webs, the injecting web 10, the blocking web 30, which may be consumable, and the paper web 60 are employed to effect the basic photoelectrophoretic imaging process.

The photoelectrophoretic imaging process is carried out between the flexible injecting and blocking webs. The conductive or injecting web 10 is analogous to the injecting electrode described in earlier basic photoelectrophoretic imaging systems. The injecting web 10 is initially contained on the prewound conductive web supply roll 11, mounted for rotation about the axis 12 in the direction of the arrow. The conductive web 10 may be formed of any suitable flexible transparent or semi-transparent material. In one preferred embodiment, the conductive web is formed of an about 1 mil Mylar, a polyethylene terephthalate polyester film from DuPont, overcoated with a thin transparent conductive material, e.g., about 50% white light transmissive layer of aluminum. When the injecting web 10 takes this construction, the conductive surface is preferably connected to a suitable ground at the imaging roller or at some other convenient roller located in the web path. The bias potential applied to the conductive web surface is maintained at a relatively low value. Methods for biasing the conductive web will be explained in more particularity hereinlater. Also, by proper choice of conductor material, programmed voltage application could be used resulting in the elimination of defects caused by lead edge breakdown. The term "lead edge breakdown," as used herein, refers to a latent image defect which manifests itself in the form of a series of dark wide bands at the lead edge of a copy. Lead edge breakdown defects are believed to be caused by electrical air breakdown on air ionization at the entrance to the imaging zone.

From the conductive web supply 11, the conductive web 10 is driven by the capstan drive roller 13 to the tension rollers 14, 15, 16 and 17. The web 10 is driven from the tensioner rollers around the idler roller 18 and to the inker 19 and backup roller 20 at the inking station generally represented as 21.

The inker 19 is utilized to apply a controlled quantity of photoelectrophoretic ink or imaging suspension 4 to the conductive surface of the injecting web 10 of the desired thickness and length. Any suitable inker capable of applying ink to the required thickness and uniformity across the width of the web may be used. For example, the applicator described in U.S. Pat. No. 3,968,271 entitled "Coating Apparatus and Uses Thereof," filed Feb. 22, 1974, may be adapted for use herein. Another example of an inker that may be adapted for use herein is the inker mechanisms described in U.S. Pat. No. 3,800,743, issued Apr. 2, 1974, by Raymond K. Egnaczak.

From the inking station 21, the conductive web 10 is driven in a path passing in close proximity to the precharged station generally represented as 25. The precharge station 25 will be described more fully hereinafter.

When the conductive web 10, which now contains the coated ink film 4, exits the precharge station 25, the conductive web 10 is driven in a path around the idler roller 23 toward the imaging roller 32 in the imaging zone 40. The blocking web 30, which is analogous to the blocking electrode described in earlier photoelectrophoretic imaging systems, is initially contained on the prewound blocking web supply roll 37 mounted for rotation about the axis 35 in the direction of the arrow. The blocking web 30 is driven from the supply roll 37 by the capstan drive roller 36 in the path around the tension rollers 9, 38, 39 and 41 to the roller 42 and corotron 43 at the blocking web charge station generally represented as 44. The blocking web charge station will be described in more particularity hereinafter.

The blocking web 30 may be formed of any suitable blocking electrode dielectric material. In one preferred embodiment, the blocking web 30 may be formed of a polypropylene blocking electrode material which, as received from the vendor on the prewound supply roll 37, may be laden with random static charge patterns. These random static charge patterns have been found to vary in intensity from 0 to ±300 volts, and cause defects in the final image copy. The blocking web charge station 44, as will be explained more fully hereinafter, may be utilized to remove the random static charge patterns or at least dampen the randomness thereof, from the polypropylene blocking web material.

Still referring mainly to FIG. 1, the conductive web 10 and blocking web 30 are driven together into contact with each other at the imaging roller 32. When the ink film 4, on the conductive web 10, reaches the imaging roller 32, the ink-web sandwich is formed and is, thereby, ready for the imaging-development step to take place. The imaging step also comprises deposition and electrophoretic deagglomeration or ink splitting processes. Although the steps of "deposition," "electrophoretic deagglomeration" and "imaging" are referred to herein as being separate and distinct process steps in actuality, there is undoubtedly some overlap of the spatial and temporal intervals during which these three phenomena occur within the "nip" region. The term nip, as used herein, refers to that area proximate the imaging roller 32 where the conductive web 10 and blocking web 30 are in close contact with each other and the ink-web sandwich is formed in the imaging zone 40. The term imaging zone, as used herein, is defined as the area in which the conductive and blocking webs contact to form the nip where the optical image is focussed and exposure and imaging take place.

During the portion of the imaging step when the conductive web 10 and blocking web 30 are in contact, imaging suspension sandwiched between them at the imaging roller 32, the scanning optical image of an original is focussed between the webs. Exposure of the image is accomplished at the same time as the high voltage is being applied to the imaging roller. The photoelectrophoretic imaging machine of this invention is capable of accepting either transparency inputs from the transparency optical assembly designated as 77 or opaque originals from the opaque optical assembly represented at 78. The transparency and optical assemblies will be described in more particularity hereinafter.

When the conductive and blocking webs are brought together and the layer of ink film 4 reaches the imaging zone 40 to form the ink-web sandwich, the imaging roller 32 is utilized to apply a uniform electrical imaging field across the ink-web sandwich. The combination of the pressure exerted by the tension of the injecting web and the electrical field across the ink-web sandwich at the imaging roller 32 may tend to restrict passage of the liquid suspension, forming a liquid bead at the inlet to the imaging nip. This bead will remain in the inlet to the nip after the coated portion of the web has passed, and will then gradually dissipate through the nip. If a portion of the bead remains in the nip until the subsequent ink film arrives, it will mix with this film and degrade the subsequent images. In one preferred embodiment of this invention, liquid control means is employed to dissipate excess liquid accumulations, if any, at the entrance nip. The liquid control means will be described in detail hereinlater.

While although the field for imaging is preferably established by the use of a grounded conductive web in conjunction with an imaging roller, a non-conductive web pair in conjunction with a roller and corona device may be utilized to establish the electrical field for imaging. In the non-conductive web and corona source embodiment, the imaging roller 32 may be grounded in order to obtain the necessary field for imaging.

Still referring mainly to FIG. 1, after the process steps of pigment discharge at the discharge station 57 and recharge at the recharge station 65 (or optionally, only recharge) the conductive web 10 carries the image into the transfer zone 106 into contact with the paper web 60 to form the image-web sandwich, and the transfer step is accomplished. When the conventional electrostatic transfer method is used, the copy or paper web 60 may be in the form of any suitable paper. The paper web 60 is initially contained on the paper web supply roll 110 and is mounted for rotation about the shaft 111 in the direction of the arrow.

The photoelectrophoretic image on the conductive web 10, approaching the transfer zone 106, may include oil and pigment outside the actual copy format area and may also include excess liquid bead at the trailing edge. When the transfer step is completed, the conductive-transfer web separator roller 85 is moved to the standby position indicated by the dotted outline. This separates the conductive web 10 and paper web 60 briefly, to allow the excess liquid bead to pass the transfer zone 106 before the separator roller 85 is moved to its original position bringing the webs back into contact. A more particular description of the transfer zone will follow.

The conductive web 10 is transported by drive means away from the transfer zone 106 around the capstan roller 86 to the conductive web takeup or rewind roll 87. When the conductive web is completely rewound onto the takeup roll 87, it may be disposed of. In an alternative embodiment, the takeup roll 87 may be substituted for by an electrostatic tensioning device and the image on the web saved for observation or examination. The electrostatic tensioning device will be described in more particularity hereinafter.

The blocking web 30, which contains the negative image after the imaging step is transported by drive means around the capstan roller 36 to the blocking web takeup or rewind roll 89. When the blocking web is completely rewound onto the takeup roll 89, it may be removed from the machine and disposed of. The paper web 60 is initially contained on the paper web supply roll 110 and is transported by drive means to the transfer zone 106 and, therefrom, to fixing station 92 and around capstan roller 91. The machine web drive system for the conductive, blocking and paper webs will be described in more detail hereinafter.

Figure 2:
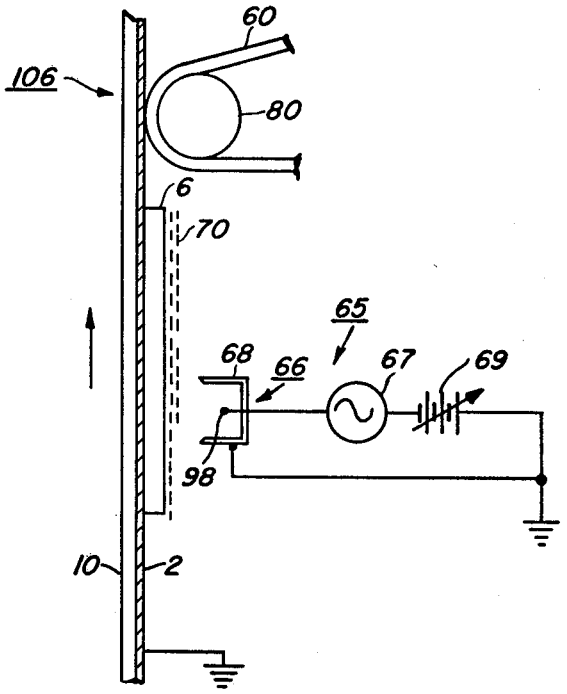
FIG. 2 is a side view, partially schematic diagram of the pigment recharge station.

Operation of the machine precharge station 25 requires that a uniform charge be applied to an ink film by a scorotron device in the manner and detail as described, for instance, in FIG. 2 plus descriptive subject matter as found in U.S. Pat. No. 4,006,982. Other suitable conventional corona charging devices may also be used, however. In addition, a description of a suitable dark charge process is found for instance, In U.S. Pat. No. 3,477,934 of Carreira et al.

Figure 3:
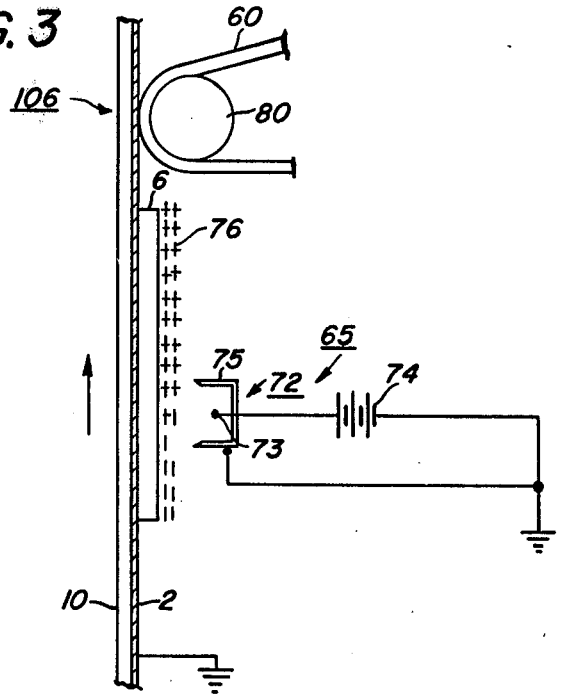
FIG. 3 is a side view of an alternative embodiment for the pigment recharge station of FIG. 2.
Figure 4:
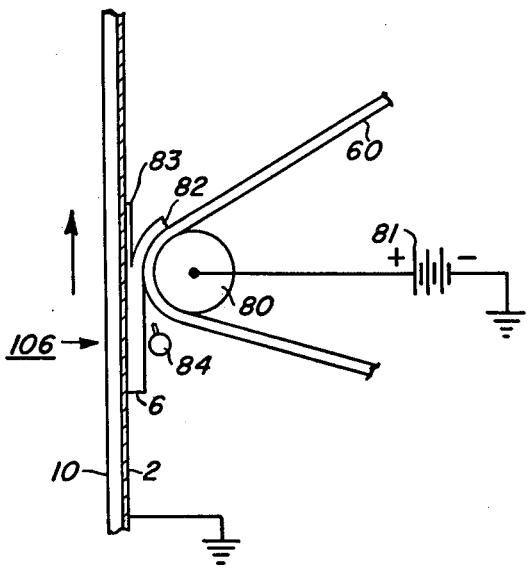
FIG. 4 shows a side view, partially schematic diagram of a detail of the transfer step and method for eliminating air breakdown.
Figure 5:
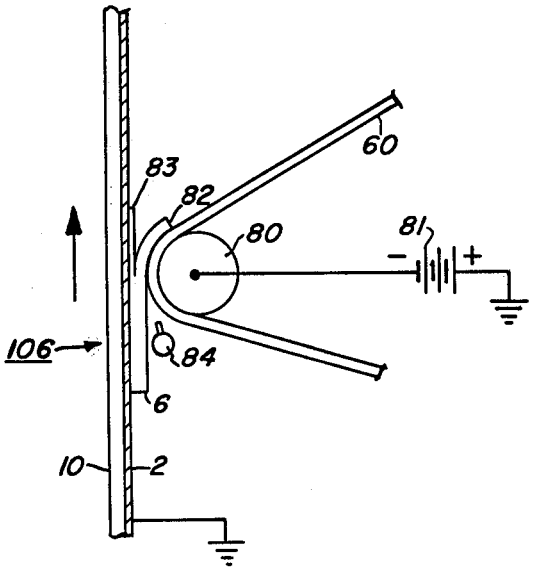
FIG. 5 shows a side view, partially schematic diagram of an alternative embodiment of the transfer step and method for eliminating air breakdown.

A suitable blocking web charging station and an imaging station for purposes of the present invention can coincide, for instance, to those found in FIGS. 3–5 with accompanying descriptions and conditions as set out in U.S. Pat. No. 4,006,982.

Referring now to FIG. 2, there is illustrated a side view, partially schematic diagram of the pigment recharge station generally represented as 65, located in the direction of travel of the conductive web 10 before the transfer zone represented as 106. The negatively biased A.C. corotron 66 is employed prior to the transfer zone to recharge the image 6 carried out of the discharging station on the conductive web 10. The corotron coronode 98 is spaced from the surface of the conductive web 10 and is coupled to the A.C. potential source 67. The corotron shield 68 is grounded. The A.C. potential source 67 is negatively biased by the variable D.C. voltage source 69. In one exemplary embodiment, the recharge currents are nominally about 10 micro-amps per inch, RMS, for the A.C. component and about −5 micro-amps per inch for the average D.C. component with a bias setting of about −1.0 KV and the conductive web velocity of about 5 inches per second. Typically, these parameters produce an optimum recharge potential at 70 of about −65 volts D.C. on the deposited pigment layer 6 when using photoelectrophoretic ink of particular characteristics.

Turning now to FIG. 3, there is shown a side view, partially schematic diagram of a preferred alternative embodiment for the pigment recharge station. In the FIG. 3 embodiment, the pigment recharge station 65 uses the positive D.C. corotron 72 prior to the transfer zone 106, to recharge the deposited photoelectrophoretic image 6. The corotron coronode 73 is spaced closely from the surface of the conductive web 10 and connected to the positive terminal of the D.C. potential source 74. The corotron shield 75 is grounded. In one example, the D.C. potential source 74 may be about +9 KV D.C. Typically, the recharge current is about 30 micro-amps per inch. These parameters produce an optimum recharge potential 76 on the deposited photoelectrophoretic image 6 of about ±160 volts D.C.

Referring now to FIG. 4, there is shown a side view, partially schematic diagram for illustrating a detail of the transfer step in accordance with one embodiment of this invention. In this embodiment, the deposited photoectrophoretic image 6 is carried by the conductive web 10 into the transfer zone 106. The paper web 60 is wrapped around the transfer roller 80 which may be formed of conductive metal. In this example, the paper web 60 may take the form of ordinary paper. The positive terminal of the D.C. voltage source 81 is coupled to the transfer roller 80. Typically, voltage source 81 is about +1.4 KV D.C. As the paper web 60 and conductive web 10 are driven into contact with the image 6 sandwiched between them, the paper web 60 is subjected to an electrical charge because it is in contact with the positive transfer roller 80. An electrostatic field is set up through pigment particles to the conductive web 10, which draws the negatively charged pigment particles to the paper web 60 from the conductive web 10 and attaches to the paper web 60. As the paper web is driven around and away from the transfer roller 80, the paper web is thereby separated or peeled away from the conductive web 10, giving the final transferred image 82 on the paper web 60. Substantially all of the pigment or photoelectrophoretic image is transferred onto the paper web 60, however, a small amount of pigment may be left behind in the form of the residual 83 and is carried away by the conductive web 10. The amount of pigment in the residual 83 will usually depend upon such factors as the charge on the pigment particles entering the transfer zone 106, properties of the paper web 60 and the applied transfer voltage by the D.C. potential source 81.

It will be noted that while the embodiments of FIGS. 4 and 5 show a residual image, complete image transfer may be achieved without any significant untransferred image or residual.

The residual or untransferred image 83, if any, is carried away from the transfer zone 106, out of the machine and may be disposed of. Because the conductive web 10 is consumable, there is no requirement for a complex cleaning system for performing a cleaning step. This is an important advantage of this machine over earlier photoelectrophoretic imaging machines.

The transfer process step, under certain circumstances, may be subjected to air breakdown in the gap entrance to the transfer zone 106 in the same manner as discussed earlier with respect to the imaging zone. Air breakdown at the entrance to the transfer zone may result in a defect in the final copy, referred to as "dry transfer." Dry transfer, as used herein, is defined as a defect manifesting itself in the final copy in the form of a speckled or discontinuous and very desaturated appearance.

In order to eliminate air breakdown at the transfer zone entrance gap and thus, eliminate dry transfer defects in the copy, a dispenser 84 is provided to apply dichlorodifluoromethane gas ($CCl_2F_2$), Freon-12 from DuPont in the entrance gap. The technique of providing dichlorodifluoromethane gas or other suitable liquid or insulating medium in the transfer zone entrance increases the level of the onset voltage necessary for corona breakdown. Thus, displacing air in the gap entrance in favor of a dichlorodifluoromethane gas atmosphere improves air breakdown characteristics. Preferably, a vacuum means is provided in the vicinity of the dichlorodifluoromethane gas dispenser 84 to prevent gas from escaping into the atmosphere.

It will also be appreciated that a fluid injecting device 24 (see FIG. 1) may be employed at the inlet nip to the imaging zone 40 to provide air breakdown medium at the imaging nip entrance in the same manner as described with regard to the transfer entrance nip.

Turning now to FIG. 5, there is shown a side view, partially schematic diagram of an alternative embodiment for illustrating the transfer step and method for eliminating air breakdown at the transfer zone entrance gap. The FIG. 5 embodiment differs from the embodiment described with respect to FIG. 4, only in that the transfer roller 80 is coupled to the negative terminal of the D.C. voltage source 81 instead of the positive terminal. It shall be apparent that the FIG. 5 embodiment is utilized whenever the deposited image 6 entering the transfer zone, is charged positive (by a positive D.C. corotron) rather than negative. In this case, the negative 1.4 KV D.C. potential source 81 is coupled to the transfer roller 80. The paper web 60 is charged by being in contact with the negative transfer roller 80. The electrostatic field is set up through the pigment particles to the conductive web 10, which draws the positively charged pigment particles to the paper web 60 from the conductive web 10 and attaches them to the paper web. The paper web 60 is then peeled from the conductive web 10 and contains the final image 82. Practically all of the pigment transfers, and in the manner described with regard to the FIG. 4 embodiment, the untransferred residual 83 is left on the conductive web 10 to be transported out of the machine and later disposed of.

THE MACHINE STRUCTURE

Figure 10:
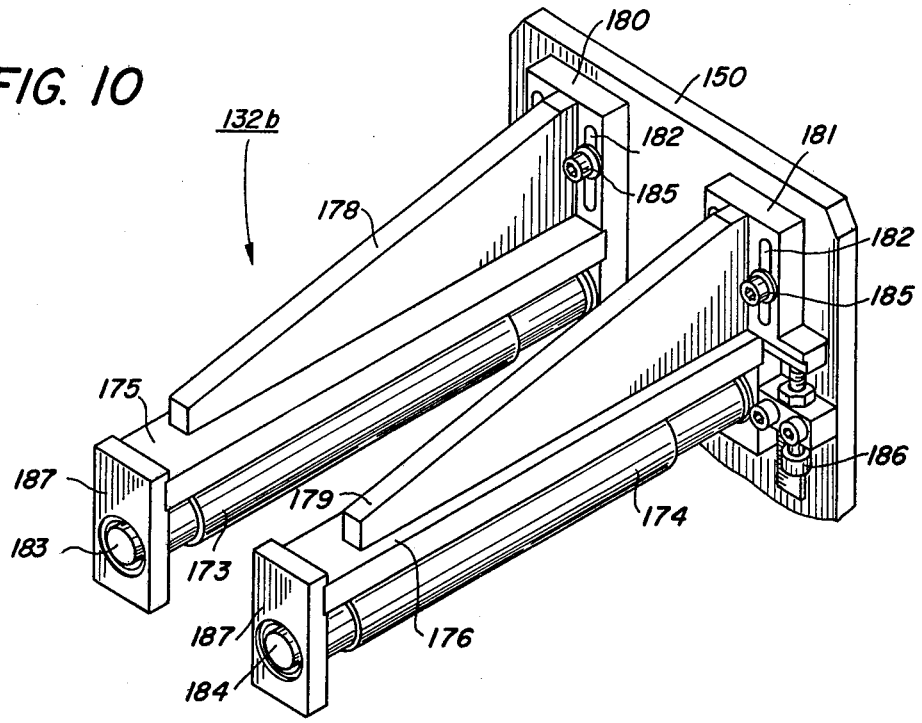
FIG. 10 is a perspective isolated view of the upper portion of the imaging assembly for the alternate machine structure.
Figure 11:
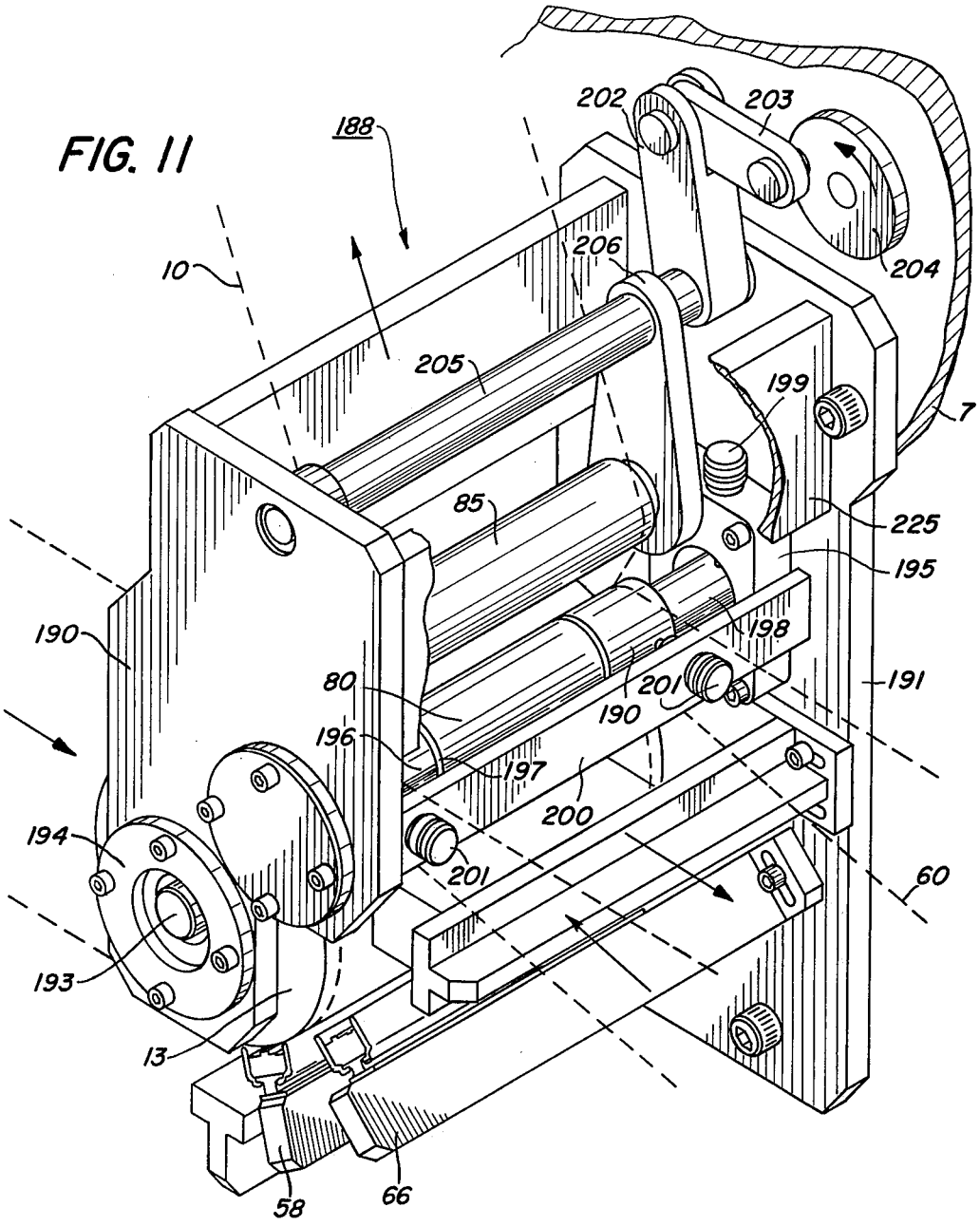
FIG. 11 is a perspective isolated view of the transfer assembly.
Figure 12:
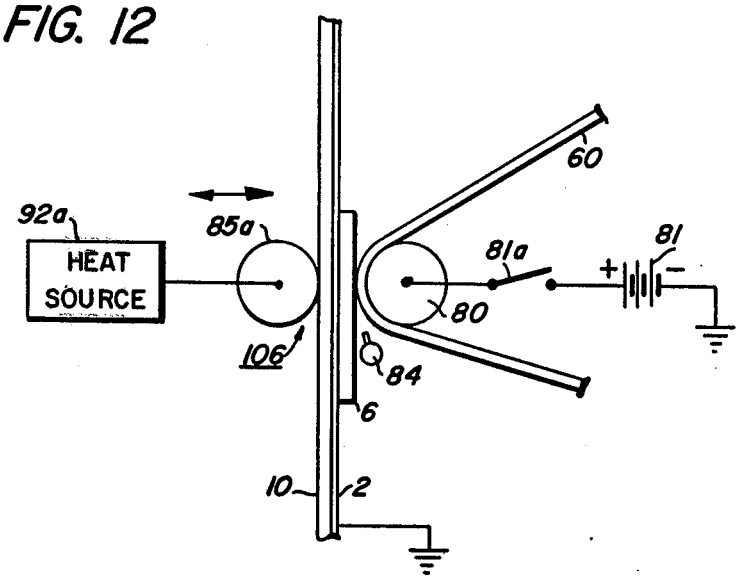
FIG. 12 shows a side view, partially schematic diagram of one preferred embodiment for transferring and fixing in one step.

Suitable machine structure inclusive of components and sub-assemblies for purposes of the present invention can be found for instance, in FIGS. 10–12 of U.S. Pat. No. 4,006,982 with accompanying description.

It will also be appreciated that the timing and sequence for the various processes and events may be accomplished by various suitable electronic control means. In this case, the sequence of events and functions are timed in cycles or hertz by a digital frequency source, rather than degrees of cam rotation.

Figure 6:
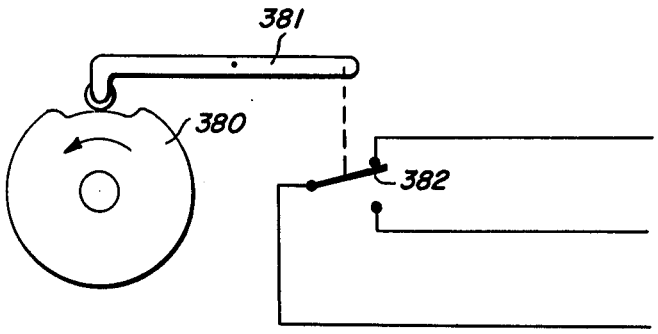
FIGS. 6–8 show typical electrical circuitry for operation of the cam operated switch.
Figure 7:
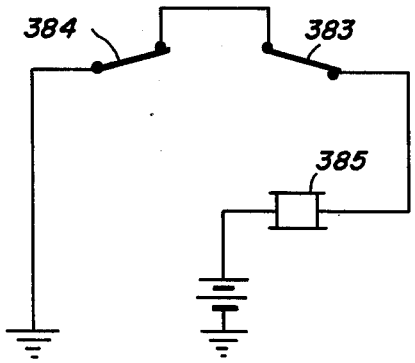
Figure 8:
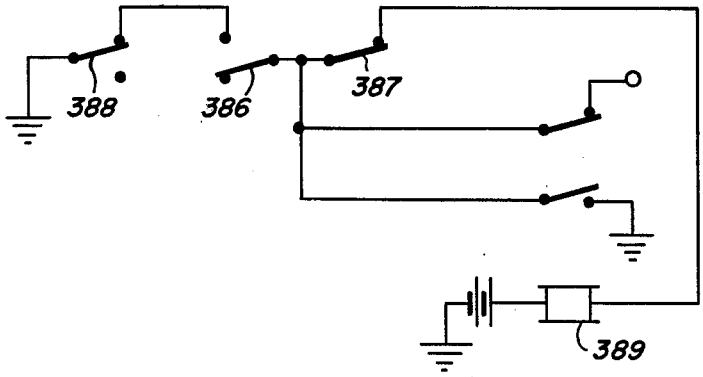

Referring now tc the FIGS. 6–8, there is shown partial schematic and electrical diagrams of typical electrical circuitry for operation of the cam operated switch according to a preferred embodiment of this invention.

The FIG. 6 shows a simplified diagram of a cam operated switch. The cam 380 rotates in the direction of the arrow and actuates the switch 382 via the cam follower 381. The FIG. 7 illustrates the circuit for events that begin and end in the same 360° cycle. The cam operated switch 383 is closed during the sequence event and the switch 384 may be opened after the last cycle. The particular event is controlled by the series relay 385.

The FIG. 8 is the electrical circuit for events that begin and end in different 360° cycles. The cam operated switch 386 is momentarily closed to start a particular event. The cam operated switch 387 is momentarily opened to end the event and after the last cycle, the switch 388 opens. The particular event is controlled by the series relay 389.

IMAGING ASSEMBLY

As will be recalled, when the conductive and blocking webs are brought together and the layer of ink film reaches the imaging zone to form the ink-web sandwich, the imaging roller is utilized to apply a uniform electrical imaging field across the ink-web sandwich. The combination of the pressure exerted by the tension of the injecting web and the electrical field across the ink-web sandwich at the imaging roller tends to restrict passage of the liquid suspension, forming a liquid bead at the inlet to the imaging nip. This bead will remain in the inlet to the nip after the coated portion of the web has passed, and will then gradually dissipate through the nip. If a portion of the bead remains in the nip until the subsequent ink film arrives, it will mix this film and degrade the subsequent images.

One method for avoiding the degrading of images from this effect would be to allow lengths of web materials, not coated with suspension, to pass through the imaging zone, after liquid bead build up, sufficient to allow all traces of liquid to pass before an imaging sequence is repeated. This method would entail a time delay between images and would also result in a great deal of waste of web material. An improved method for avoiding this degrading of images is described in U.S.

Pat. No. 3,986,772, filed June 4, 1974, entitled "Bead Bypass" by Herman A. Hermanson. The Hermanson bead bypass system is employed to separate two surfaces momentarily immediately after completion of imaging to permit the passage of the liquid bead between image frames.

Another bead bypass system for use in photoelectrophoretic imaging systems, wherein process steps are carried out concurrently or in a timed sequence, is described in U.S. Pat. No. 3,989,365, filed June 4, 1974, entitled "Motion Compensation For Bead Bypass" by Roger G. Teumer, Earl V. Jackson and LeRoy Baldwin. The Teumer et al disclosure is hereby specifically incorporated by reference herein. The Teumer et al motion compensating bead bypass sytem is employed in the imaging assembly 98 of the instant invention to separate the conductive and blocking webs, having liquid suspension sandwiched between them, to allow the liquid bead formed at the line of contact between the webs to pass therebetween beyond the imaging areas between frames without changing web velocity. After the webs have been moved into contact with each other at the nip, imaging suspension sandwiched therebetween, the separation of the webs may be obtained at the desired time by the use of the cam switch timing system.

THE OPTICAL ILLUMINATION SYSTEM

Figure 9:
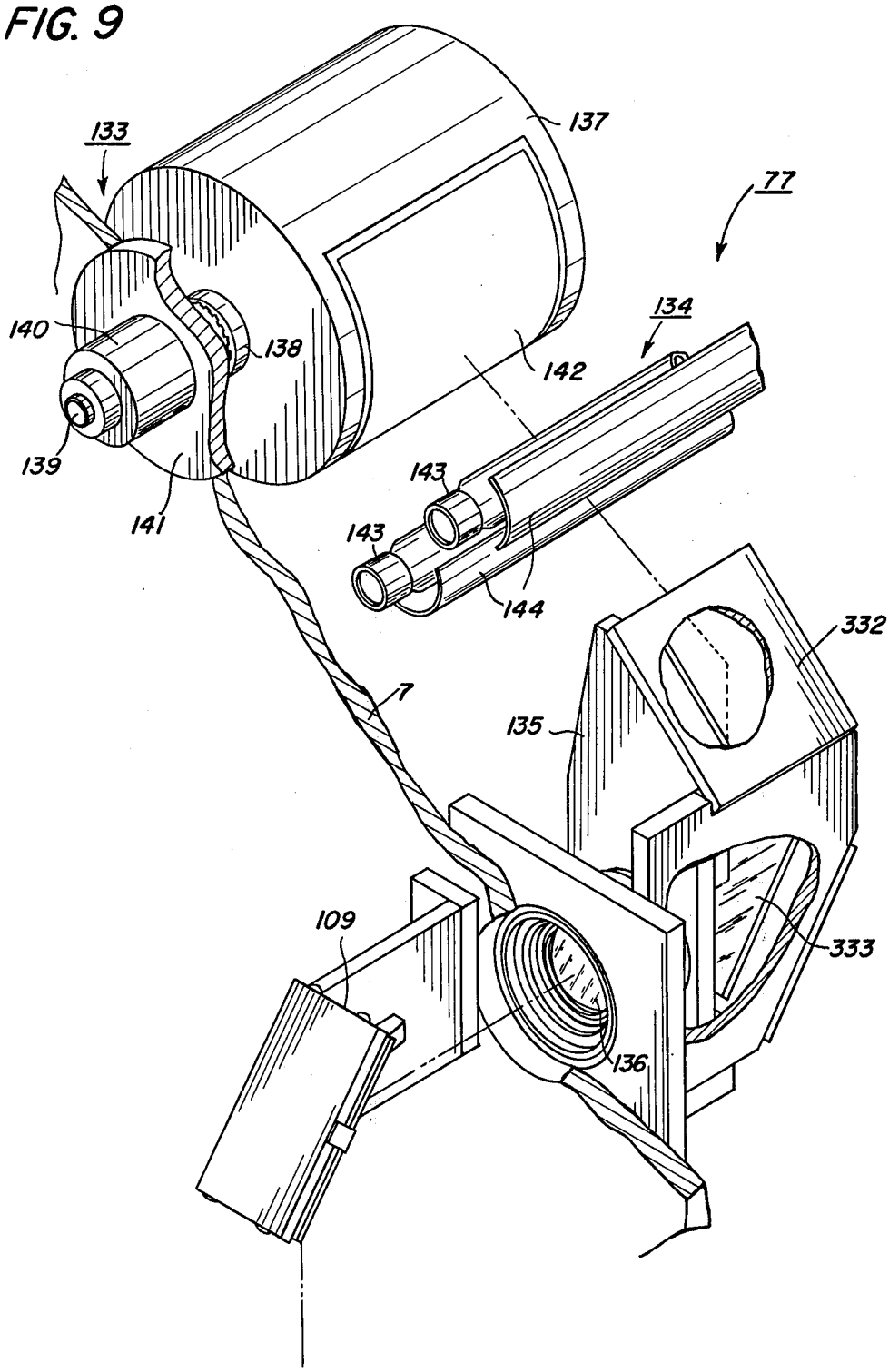
FIG. 9 is a partially cutaway pictorial view of the opaque optical assembly.

In FIG. 9, there is seen a partial cutaway, pictorial illustration of the opaque optical assembly 77, according to this invention. The opaque optical assembly comprises the drum assembly 133, the lamp source 134, the rear mirror assembly 135, the lens assembly 136 and the front mirror assembly 109. The drum assembly 133 consists of the roller drum 137 rotatably mounted to the rear of the main plate frame 7. The roller drum 137 may be formed of conductive metal and is driven by a drive means (not shown) coupled to the drive pulley 138 and drive shaft 139 contained within the bearing housing 140. The drum is attached to the frame 7 by means of the housing base 141 and is adapted to accommodate a positive opaque original document 142 on the drum surface. The original document 142 is exposed by the illumination lamp source 134 comprising the lamps 143 and reflectors 144. The lamps 143 may be metal halide arc lamps by General Electric Corporation. Alternatively, the lamps 143 may be of the tunsten filament type. The exposed image is refected to the rear mirror assembly 135 comprising mirrors 332 and 333 through the lens assembly 136 to the front mirror assembly 109 and then to the imaging zone.

A transparency projector and lens assembly may be employed at a convenient location within the machine to project light rays of a color slide to the imaging zone via a mirror assembly. The method and technique for the use of transparency optical inputs in the web device photoelectrophoretic imaging machine will be described in more particularly hereinlater.

THE ALTERNATE MACHINE STRUCTURE

Suitable alternate machine structure and assembly for such structure can be found, for instance, in FIGS. 13–14 with accompanying description as found in U.S. Pat. No. 4,006,982.

The FIG. 10 shows a perspective isolated view of the imaging assembly upper portion designated as **132*b*. The rollers 173 and 174 are rotatably mounted by the fixtures 175 and 176, respectively, to the main support 150. The roller 173 is positioned above the imaging zone entrance and roller 174 is located above the imaging zone exit. The fixtures 175 and 176 are provided with tappered flange members 178 and 179, respectively. The flange members are connected to the base plates 180 and 181 which contain vertical slots 182. The imaging zone entrance roller 173 and exit roller 174 roller shafts 183 and 184, respectively, are supported by the base plates 180 and 181 and end members 187**.

The adjustable attaching members 185 in conjunction with the slots 182 may be used to adjust the rollers 173 and 174 in a vertical plane to thereby adjust the imaging gap and wrap angle. The fine adjust means 186 are provided for each of the rollers 173 and 174 and may be used to obtain precise gap settings.

THE TRANSFER ASSEMBLY

Referring now to FIG. 11, there is shown a perspective isolated view of the transfer assembly designated as 188. The transfer assembly 188 includes the front and rear plates 190 and 191, respectively. The rear plate 191 is utilized to attach the transfer assembly 188 to the main frame 7. The capstan drive roller 13 is used to transport the conductive web 10 into contact with the paper web 60 at the transfer zone. The capstan drive roller shaft 193 is rotatably mounted between the front and rear plates 190 and 191 by the bearing block 194 provided at one end of the shaft 193. The other end of the capstan drive roller shaft 193 extends beyond the rear plate 191 and the frame plate 7 and may be connected to capstan roller drive means through drive pulley and timing belt means, not shown.

The discharge corotron 58 that may be used to discharge the photoelectrophoretic image carried by the conductive web from the imaging zone, is mounted to the rear plate 191 adjacent and in an axis parallel to the drive roller 13. The pigment recharge corotron 66 is mounted in a similar fashion to the rear plate 191 in the direction of travel of the conductive web 10 after the discharge corotron 58.

The transfer roller 80, used to effect the electrostatic transfer step, is rotatably mounted by the bearing blocks 195 that are attached to the front and rear plates 190 and 191. The transfer roller 80 construction may be similar to the imaging roller construction. For example, the transfer roller 80 is provided with concentric insulator rings (not shown) and the conductive end sleeves 196. Grooves or indentations 197 are provided on the transfer roller 80 near the ends to prevent pigment and oil liquid from spilling out from the edge of the webs. The bearing blocks 195 that are used to mount the transfer roller 80 are formed of an insulator material and all provided with electrical connector means 199 to couple an electrical voltage source to the transfer roller shaft 198. The bar 200, which extends parallel with an in close proximity to the transfer roller 80, is provided with the brush assemblies 201 used to couple the end sleeves 196 to an electrical bias or ground.

The image deposited on the conductive web 10 approaching the transfer zone, includes oil and pigment which may be outside the actual copy format area and may also include a relatively large bead of oil at the trailing edge. This excess oil, if allowed to remain in the copy format area, may adversely affect the transferred image. This excess oil may be removed from the transfer zone by separating the paper web 60 from contact with the conductive web 10, briefly after the transfer step to allow excess oil and pigment to clear the transfer zone. Web separation at the transfer zone is accomplished by moving the conductive-transfer web separator roller 85 by driving the link 202 and arm 203 by the drive means 204. The link 202 and arm 203 are coupled to the separator roller 85 through the rod pivot 205 and support arms 206. Initially, the conductive and paper webs are separated apart. In this case, the roller 85 is in the standby or non-transfer mode. Upon receiving an actuation signal, the drive means moves in the direction of the arrow causing the separator roller 85 to move toward the transfer roller 80, thus bringing the webs together. When a second signal is received by the drive means 204, the drive means rotates and the separator roller 85 returns to the standby position. This sequence may be repeated for the next successive transfer step.

Referring now to FIG. 12, in one preferred embodiment, the paper transfer web 60 may take the form of polyamide coated paper. When polyamide coated paper is used as the paper web 60, photoelectrophoretic imaging machines employing the disposable web configuration may be further simplified. In such case, the transfer and fixing steps may be accomplished in one step by bringing the conductive web into contact with the polyamide coated paper web 60 at the transfer zone 106 between two rollers and applying heat and pressure. The pressure roller **85*a* moves under force in the direction of the arrow to bring the webs into contact at the transfer zone 106, the image 6 sandwiched between the two webs. The pressure roller 85*a* is coupled to the heat source 92*a*. This results in a substantially complete transfer of all pigment particles from the conductive web 10 to the polyamide coated paper web 60** and the image is fixed simultaneously.

In still another alternative embodiment, an electric field may be applied during the application of heat and pressure. In this case, the switch **81*a* is used to couple the voltage source 81 to the transfer roller 80**.

THE WEB DRIVE SYSTEM

A suitable web drive systems, sensor, and tensioning arrangements can be found, for instance, in FIGS. 17, **17*a* and 17*b*** with accompanying description as found in U.S. Pat. No. 4,006,982.

THE WEB SERVO SYSTEM DRIVE CONTROL

A suitable conductive web servo control drive system, controls, and operation for purposes of the present invention can be found, for instance, in FIGS. 18–25 and accompanying description in U.S. Pat. No. 4,006,982.

IN OPERATION

The sequence of operation of the web device photoelectrophoretic imaging machine is as follows:

At standby, the conductive web supply roll, adequate for the desired copies to be made, is provided. The conductive web supply roll is braked by the adjustable hysteresis brakes at constant torque supplying low tension in the web coming off the supply roll. The blocking web supply, adequate for the desired copies to be made, is provided. The blocking web supply roll is also provided with hysteresis brakes (controlled by radius sensors for maintaining tension in the same manner as for the conductive web). The transfer or paper web supply roll, sufficient for the desired number of copies, is provided. The paper supply roll is also braked by hysteresis brakes.

The conductive web is driven at constant speed by the capstan drive roller driven by the torque motor. The conductive web takeup roller is driven by a torque motor for variable torque at the takeup roller. Alternatively, the conductive web takeup roller may be replaced by the electrostatic capstan driven by a torque motor for constant torque output. The blocking web takeup roller is driven in the same manner as the conductive web takeup to maintain a constant tension level. The paper web drive is an electrostatic capstan which supplies tension to the web via electrostatic tacking. Tension on the paper web varies as the supply roll diameter varies.

When the power is turned on initially, power is supplied to the torque motors driving the three web takeups and tension is applied to the webs. At the start of the photoelectrophoretic imaging process, the conductive web is accelerated to the desired imaging velocity. The inker starts applying the ink film to the conductive web surface at the desired ink film thickness and length. When the conductive web reaches the precharge station, the deposition scorotron applies the precharge voltage to the ink layer. The amount of potential to be applied by the scorotron will depend upon the characteristics of the photoelectrophoretic ink used in the system. When photoelectrophoretic imaging suspension of particular properties are used, the scorotron applies a high charge resulting in total pigment deposition. When photoelectrophoretic ink having other properties is used, a slightly lower charge is applied by the scorotron and will not result in total pigment deposition.

Before the ink film reaches the imaging station, the blocking web drive motor (by cam switch timing) is switched to speed mode and accelerates the blocking web to match the velocity of the injecting web. The blocking web is subjected to the corotron high voltage just prior to entering the imaging zone to assure against stray fields. As the lead edge of the ink film carried on the injecting web approaches the imaging roller, the web separator mechanism is closed by the cam switch timing system to bring the webs into contact at the imaging roller to form the ink-web sandwich at the nip. The blocking web drive motor is switched, via a switch on the separator mechanism, back to the torque mode. The imaging voltage is then applied to the imaging roller as the ink film passes over the imaging roller while the scanning optical image, from either the transparency or opaque optical input system, is projected to the imaging zone. The imaging voltage may be ramped by programming means to allow the voltage to be raised up to the desired operating level while the imaging entrance nip is being filled with liquids.

The main drive capstan roller drives the conductive web through friction contact at the desired web velocity. The friction capstan is driven by the D.C. servomotor that also drives the scan for both the opaque and transparency optics and the cam switch timing system. During the time the webs are in contact at the nip, the blocking web is driven by the conductive web through friction force between the webs. After the image is formed, the conductive web is separated from the blocking web and the blocking web drive returns to the speed mode until the next ink film approaches the imaging roller or a cam switch signals it back to the torque mode at the end of the cycle and the web stops. During the period when the webs are separated out of contact, the liquid bead buildup at the entrance nip is passed through the imaging zone by the conductive web.

The cam switch timing system operates to allow concurrent photoelectrophoretic process steps of inking, imaging and transfer. When the imaging process step for an ink film is being completed, the next successive ink film is applied to the conductive web.

After the imaging step and development takes place, the pigment on the conductive web may be discharged and then recharged by the corotrons. Alternatively, depending upon the characteristics of the ink used, the discharge step may be omitted and the ink film is recharged only. When the leading edge of the photoelectrophoretic image on the conductive web approaches the transfer zone, the paper web drive motor is switched to speed mode by the cam switch timing to accelerate the paper web to a velocity to closely match the conductive web velocity. The transfer engaging mechanism is actuated by a cam switch to bring the conductive web into contact with the paper web at the transfer roller and a switch on the transfer separator mechanism returns the paper drive motor to torque mode.

When the transfer step is being completed, the next successive ink film is being imaged and concurrently therewith, another ink film is being applied to the conductive web. Concurrent operation of the photoelectrophoretic process steps results in the saving of web materials to reduce cost and improve machine thruput.

Prior to the transfer step, the fluid injecting device provided at the transfer zone entrance, is used to apply an air breakdown medium to the deposited image in order to eliminate air breakdown defects. A fluid injecting device may also be provided at the entrance nip to the imaging zone and the air breakdown reducing medium is applied to the entrance nip prior to the imaging step.

During the time that transfer takes place, the paper web drive motor remains in torque mode and the conductive web drives the paper web through friction contact at the transfer nip. When the transfer step is completed, the transfer separator mechanism is actuated by the cam switch timing system, and the paper drive motor is switched back to speed mode. The conductive and the paper webs separate briefly. This will allow liquid bead that may accumulate at the entrance nip to pass out of the transfer zone.

The transferred image on the paper web is transported to the fixing station to fuse the image and to the paper receiving chute. A trimming station may be providing to trim the copy to the desired size. The conductive and blocking webs are driven by drive capstans onto the flanged rewind spools. The rewind spools are removable and are driven by separate drive motors. The torque outputs for the motors for the rewind spools are controlled by feedback from radius sensors.

The conductive web rewind spool may be replaced by the electrostatic capstan for use when saving or examining the image on the conductive web. The conductive web electrostatic capstan is driven by a torque motor set at constant torque sufficient to overcome friction of the system and accelerate the web. The conductive surface of the web is grounded and a pulse voltage applied to the capstan roller to tack the web to the roller.

The above sequence steps are repeated for multiple copies. At the start of the last copy, after the last required ink film is applied, the machine logic control disables the inker until a new run is initiated. After the last copy is imaged, the separator mechanism remains open in standby and the blocking web drive stops. After the last transfer, the transfer separator moves the transfer engaging roller to standby separating the conductive and paper web. As the residual image, if any, on the conductive web exits the transfer roller, the conductive web is stopped. The paper web continues in speed mode until the transferred image is out of the machine and a time delay relay switches the paper drive motor back to torque mode, stopping the paper web.

In the alternative machine embodiment, the photoelectrophoretic process steps of inking, deposition, imaging and transfer are separate and distinct in time occurrence. First, the conductive web is inked and the inked web is transported to the imaging zone. The ink film is subjected to the deposition step and passed to the imaging zone for imaging. The image formed on the conductive web is discharged and recharged, or alternatively, recharged only prior to transfer. The fluid injecting device provided at the imaging nip entrance and the transfer nip entrance may be used to apply an air breakdown reducing medium into the imaging and transfer nips before imaging and transfer. When the transfer process step is completed, the next successive ink film is applied to the conductive web, and the foregoing sequence steps are repeated for multiple copies.

Other modifications of the above-described invention will become apparent to those skilled in the art and are intended to be incorporated herein.

What is claimed is:

1. A transfer assembly for transfer and fixation of photoelectrophoretic image containing pigment particles and insulating carrier fluid from a flexible charge-conductive belt or web to a transfer sheet, belt, or web containing thermoplastic material comprising:

means for inking and image-wise exposing the charge conductive belt or web in temporary conjunction with a blocking electrode in an electric field to obtain at least one photoelectrophoretic image; and means for advancing and guiding the flexible charge conductive belt or web and formed image through an image transfer zone having, heating means in temporary biased movable contact with the non-imaging side of the advancing flexible charge-conductive belt or web, a guide or roll for guiding the transfer sheet, belt or web into temporary contact with at least part of the biased charge conductive belt and image within the image transfer zone along a line about opposite the biased heating means; and means for diluting the atmosphere to vary the dielectric properties thereof at one or more nips between the charge-conductive belt or web and the transfer sheet, belt or web.

2. The transfer assembly of claim 1 wherein an electric field is applied across the image bearing charge conductive belt or web and the backing guide or roll for guiding the transfer sheet, belt, or web at the image transfer zone.

3. The transfer assembly of claim 1 wherein the heating means is a heated roller in temporary position biasing the image bearing charge conductive belt or web against the transfer sheet and its backing guide or roll.

* * * * *